US009198260B1

(12) United States Patent
Zhou et al.

(10) Patent No.: US 9,198,260 B1
(45) Date of Patent: Nov. 24, 2015

(54) LIGHT-EMITTING SIGNAL CONTROL CIRCUITS

(71) Applicant: EverDisplay Optonics (Shanghai) Limited, Shanghai (CN)

(72) Inventors: Xing Yu Zhou, Shanghai (CN); Yu Hsiung Feng, Shanghai (CN)

(73) Assignee: EVERDISPLAY OPTRONICS (SHANGHAI) LIMITED, Shanghai (CN)

( * ) Notice: Subject to any disclaimer, the term of this patent is extended or adjusted under 35 U.S.C. 154(b) by 0 days.

(21) Appl. No.: 14/737,864

(22) Filed: Jun. 12, 2015

(30) Foreign Application Priority Data

Jun. 18, 2014 (CN) ..... 2014 1 0273236

(51) Int. Cl.
*G09G 3/30* (2006.01)
*H05B 37/02* (2006.01)

(52) U.S. Cl.
CPC ..... *H05B 37/02* (2013.01)

(58) Field of Classification Search
CPC ..... G09G 3/30
USPC ..... 315/291, 294, 297, 224, 169.3; 345/82–92
See application file for complete search history.

(56) References Cited

U.S. PATENT DOCUMENTS

2013/0134897 A1 5/2013 Tan et al.
2014/0139412 A1* 5/2014 Han ..... G09G 3/34 345/82

FOREIGN PATENT DOCUMENTS

CN 102682705 9/2012
CN 103123773 5/2013

* cited by examiner

*Primary Examiner* — Douglas W Owens
*Assistant Examiner* — Jonathan Cooper
(74) *Attorney, Agent, or Firm* — Andrew F. Young, Esq.; Lackenbach Siegel, LLP

(57) ABSTRACT

One embodiment of the present invention discloses a light-emitting signal control circuit comprising: a first driving transistor for allowing a voltage to be output from a first voltage source to a output end under the control of a low level drive signal; a second driving transistor for allowing a voltage to be output from a second voltage source to the output under the control of a second low level drive signal; a first transmission control transistor connected between the first voltage source and the control end of a first driving transistor; a control signal unit for generating the first low level drive signal and the second low level drive signal; a voltage stabilizer connected between the second low level drive signal and first transmission control transistor. The circuit will suppress the voltage fluctuation on the control end of the first transmission control transistor.

14 Claims, 13 Drawing Sheets

LIGHT-EMITTING SIGNAL CONTROL CIRCUITS

CROSS-REFERENCE TO RELATED APPLICATIONS

The present application claims priority to and the benefit of Chinese Patent Application No. CN 201410273236.2, filed on Jun. 18, 2014, the entire content of which is incorporated herein by reference.

BACKGROUND OF THE INVENTION

1. Field of the Invention

The present disclosure relates to the field regarding electronic technique, more specifically, to control circuits.

2. Description of the Related Art

Organic Light-Emitting Diode (OLED) Displays are displays which use semi-conductor materials and light-emitting materials driven by control signals to emit light for displaying. OLED is considered to be the technique with the most development prospect because of its features of ultra light, ultra thin, high brightness, wide perspective, self-luminous, swift response, high definition, low consumption, low temperature, good anti-seismic property and so on. Organic Light-Emitting Diode Driving Circuits are the important parts of Organic Light-Emitting Diode Displays. Moreover, the driving circuit generating controlling light-emitting signals is the key for lightening Organic Light-Emitting Diode. To control the controlling light-emitting signals more accurately, the light-emitting signal control circuit must works in a stable state. However, the existing light-emitting control circuits are not good at circuit stability, which influences the performance of the organic light-emitting diode devices.

SUMMARY OF THE INVENTION

An embodiment of the present disclosure is directed toward a light-emitting signal control circuit capable of suppressing the voltage fluctuation on the control end of the first transmission control transistor.

A light-emitting signal control circuit, comprising:

a first driving transistor, for allowing voltage to be output from a first voltage source to an output end when controlled by a first low level drive signal;

a second driving transistor, for allowing voltage to be output from a second voltage source to the output end when controlled by a second low level drive signal;

a first transmission control transistor, connected between the first voltage source and the control end of the first driving transistor, for generating a high level drive signal under the action of the second low level drive signal to turn off the first driving transistor;

a control signal unit, for generating the first low level drive signal and the second low level drive signal according to a set of control signals which are input into the control signal unit; and a voltage stabilizer, connected between the second low level drive signal and the control end of the first transmission control transistor, for stabilizing the second low level drive signal.

According to one embodiment of the present disclosure, wherein the control signal comprises a driving signal controllably outputting metabolic level signals to a first reference node;

the first reference node is connected to the control end of the second driving transistor.

According to one embodiment of the present disclosure, wherein the voltage stabilizer is a transistor.

According to one embodiment of the present disclosure, wherein the first voltage source is connected to the first reference node by connecting with a sixth transmission control transistor and a seventh transmission control transistor in series, and the first voltage source controllably outputs a high level drive signal to the first reference node.

According to one embodiment of the present disclosure, further comprising:

a second clock signal, connected to a second reference node, for outputting high level signals or low level signals to the second reference node;

wherein, the second clock signal is connected to the control end of the seventh transmission control transistor.

According to one embodiment of the present disclosure, wherein the second reference node is connected to a third reference node by connecting with a ninth transmission control transistor and a tenth transmission control transistor in series; the third reference node is connected to the control end of the first driving transistor to provide the first low level drive signal; the second reference node is connected to the control end of the tenth transmission control transistor.

According to one embodiment of the present disclosure, further comprising:

a fourth reference node;

wherein, a third transmission control transistor is connected in series between the fourth reference node and the second voltage source to controllably output a third low level drive signal to the fourth reference node.

According to one embodiment of the present disclosure, wherein the control signal comprises a first clock signal connecting to the control end of the third transmission control transistor.

According to one embodiment of the present disclosure, wherein the first clock signal outputs high level signals to the fourth reference node by connecting with a fifth transmission control transistor and a fourth transmission control transistor in series; the control end of the fifth transmission control transistor and the control end of the fourth transmission control transistor are connected to the first reference node.

According to one embodiment of the present disclosure, further comprising:

a first capacitor coupled between the first voltage source and the control end of the first driving transistor, for maintaining the voltage on the control end of the first driving transistor.

According to one embodiment of the present disclosure, further comprising:

a second capacitor, connected the first reference node and the second reference node, for maintaining the coupling of voltage or capacitance in a preset time to pull down voltages.

According to one embodiment of the present disclosure, further comprising:

a third capacitor whose one end is connected to the fourth reference node and another end is connected to the node where the ninth transmission control transistor connects to the tenth transmission control transistor in series.

According to one embodiment of the present disclosure, wherein the fourth reference node is connected to the control end of the ninth transmission control transistor and to the control end of the sixth transmission control transistor.

According to one embodiment of the present disclosure, further comprising:

a second transmission control transistor whose control end is connected to the first clock signal and connects the driving signal and the first reference node under the control of the first clock signal.

BRIEF DESCRIPTIONS OF THE DRAWINGS

The accompanying drawings, together with the specification, illustrate exemplary embodiments of the present disclosure, and, together with the description, serve to explain the principles of the present invention.

DETAILED DESCRIPTION

Figure 1:
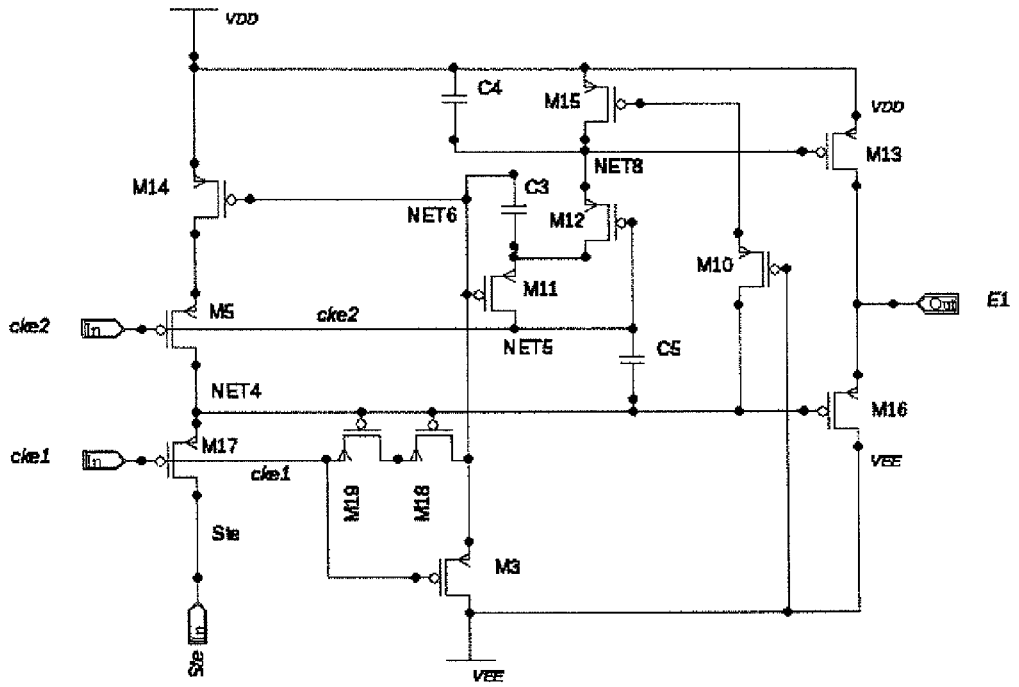
FIG. 1 is a circuit diagram according to an embodiment of the present invention.
Figure 2:
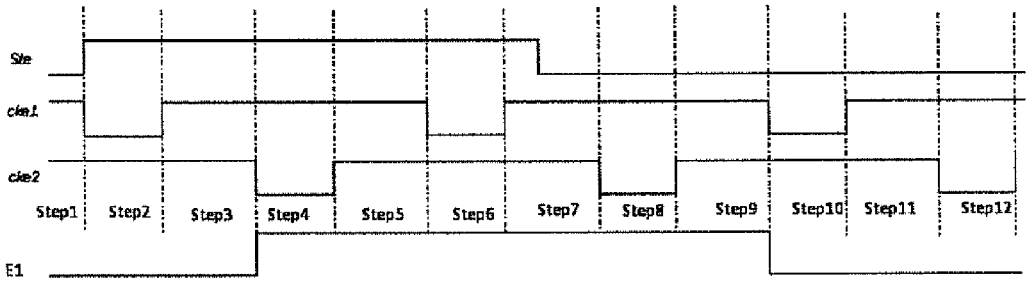
FIG. 2 is a sequence oscillogram of the control signals and the output end.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

As shown in FIG. 1, an embodiment of the present invention discloses a light-emitting signal control circuit comprising:

a First Driving Transistor M13 which turns on under the control of the input from a First Voltage Source VDD and the First Low Level Driving Signal on the control end of First Driving Transistor M13, to output high level output signals to an Output End E1;

a Second Driving Transistor M16 which turns on under the control of the input from a Second Voltage Source VEE and the Second Low Driving Signal on the control end of Second Driving Transistor M16, to output low level output signals to Output End E1;

a First Transmission Control Transistor M15 connected between First Voltage Source VDD and First Driving Transistor M13, wherein First Driving Transistor M13 works in the cut-off state when the control end of First Transmission Control Transistor M15 turns on under the action of the Second Low Driving Signal and generates a high level driving signal;

a Control Signal Unit for generating First Low Driving Signal and Second Low Driving Signal according to the a set of the input control signal;

a Voltage Stabilizer M10 connected between Second Low Level Driving Signal and the control end of First Transmission Control Transistor M15, for stabilizing Second Low Level Driving Signal.

According to a preferred embodiment of the present invention, the control signal comprises a Drive Signal Ste which controllably output metabolic level signals to a First Reference Node NET 4. First Reference Node NET 4 connects to the control end of Second Driving Transistor M16.

According to a preferred embodiment of the present invention, First Voltage Source VDD connects to First Reference Node NET 4 by connecting with a Sixth Transmission Control Transistor M14 and a Seventh Transmission Control Transistor M5 in series, to controllably output a High Level Driving Signal to First Reference Node NET 4.

According to a preferred embodiment of the present invention, the circuit further comprises a Second Clock Signal Cke2 connecting to Second Reference Node NET 5, for proving High Level Signal or Low Level Signal to Second Reference Node NET 5. Second Clock Signal Cke2 is connected to the control end of Seventh Transmission Control Transistor M5.

According to a preferred embodiment of the present invention, Second Reference Node NET5 connects to a Third Reference Node NET8 by connecting with a Ninth Transmission Control Transistor M11 and a Tenth Transmission Control Transistor M12 in series, and Third Reference Node NET8 connects to the control end of First Driving Transistor M13, to provide First Low Level Driving Signal. Second Reference Node NET5 connects the control end of Tenth Transmission Control Transistor M12.

According to a preferred embodiment of the present invention, the circuit further comprises a Fourth Reference Node NET6. A Third Transmission Control Transistor M3 is connected between Fourth Reference Node NET6 and Second Voltage Source VEE in series, to controllably provide a Third Low Level Driving Signal to Fourth Reference Node NET6.

According to a preferred embodiment of the present invention, the control signal comprises a First Clock Signal Cke1 connecting to the control end of Third Transmission Control Transistor M3.

According to a preferred embodiment of the present invention, First Clock Signal Cke1 provides High Level Signal to Fourth Reference Node NET6 by connecting with a Fifth Transmission Control Transistor M19 and a Fourth Transmission Control Transistor M18 in series. The control end of Fifth Transmission Control Transistor M19 and the control end of Fourth Transmission Control Transistor M18 are connected to First Reference Node NET4.

According to a preferred embodiment of the present invention, the circuit further comprises a First Capacitor C4 coupled between First Voltage Source VDD and the control end of First Driving Transistor M13, for maintain the voltage on the control end of First Driving Transistor M13.

According to a preferred embodiment of the present invention, the circuit further comprises a Second Capacitor C5 connected between First Reference Node NET4 and Second Reference Node NET5, for maintain the coupling of voltage or capacitance to pull down the voltage.

According to a preferred embodiment of the present invention, the circuit further comprises a Third Capacitor C3 whose one end is connected to Fourth Reference Node NET6 and another end is connected to the point connecting to Ninth Transmission Control Transistor M11 and Tenth Transmission Control Transistor M12.

According to a preferred embodiment of the present invention, Fourth Reference Node NET6 is connected to the control end of Ninth Transmission Control Transistor M11 and the control end of Sixth Transmission Control Transistor M14.

According to a preferred embodiment of the present invention, the circuit further comprises a Second Transmission Control Transistor M17 whose control end is connected to First Clock Signal Cke1. The control end of Second Transmission Control Transistor M17 is controlled by First Clock Signal Cke1 to connect Drive Signal Ste with First Reference Node NET4.

In the present embodiments, First Voltage Source VDD is a high level voltage, and Second Voltage Source VEE is a low level voltage.

According to a preferred embodiment of the present invention, the transmission control transistors and the driving transistors are all P-type TFT (Thin Film Transistor).

Figure 3:
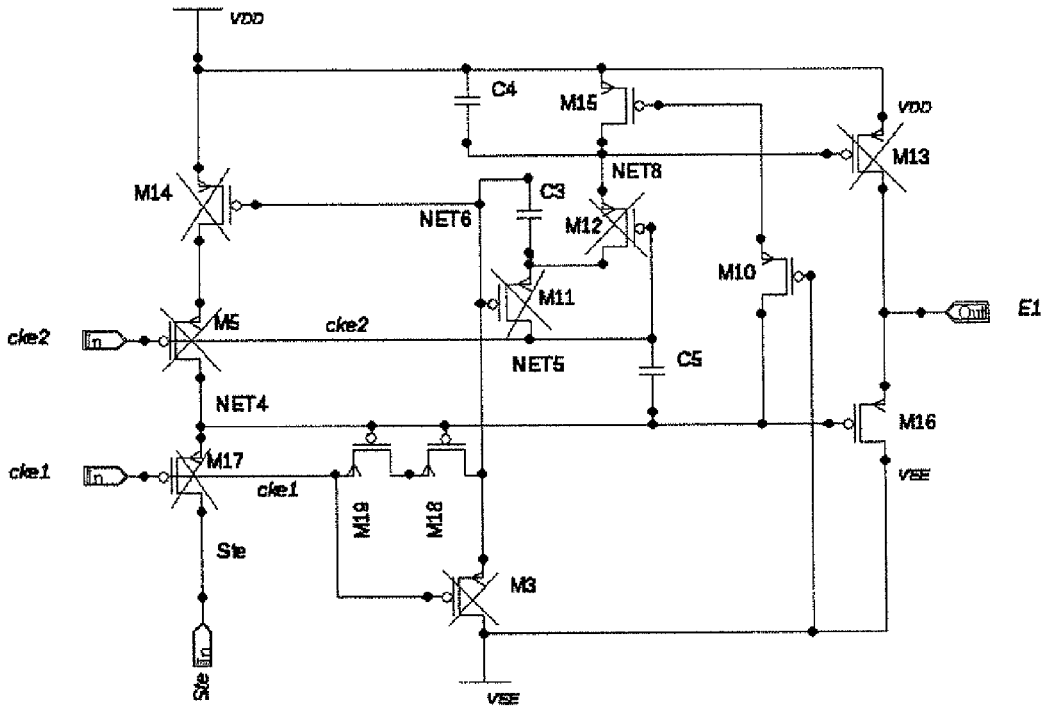
FIG. 3 is a schematic of Step 1 in accordance with the on-off states of the devices in the circuit shown in FIG. 2.

As shown in FIGS. 1 to 14, the specific processes based on an embodiment of the present invention will be illustrated as follows:

Step 1: the input in Driving Signal Ste is a low level, the input in First Clock Signal Cke1 is a high level, and the input in Second Clock Signal Cke2 is a high level; as shown in FIG. 3, First Reference Node NET4 keeps Low Level Voltage VEE under the action of Second Capacitor C5; Fourth Transmission Control Transistor M18 and Fifth Transmission Control Transistor M19 turn on; Voltage Stabilizer M10 turns on under the control of Low Level VEE, and the control end of First Transmission Control Transistor M15 turns on under the control of Low Level Voltage VEE; as the control end of First Driving Transistor M13 is High Level Voltage VDD, First Driving Transistor M13 is off; the control end of Second Driving Transistor M16 turns on under the action of low level signal to output Low Level Signal to Output End E1.

Figure 4:
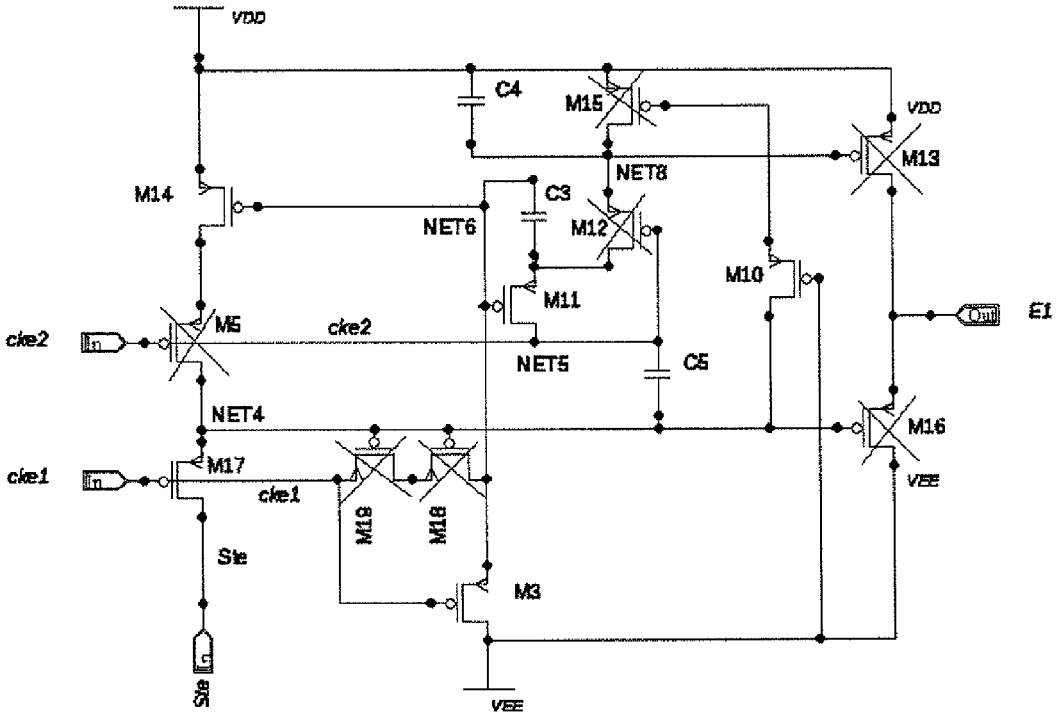
FIG. 4 is a schematic of Step 2 in accordance with the on-off states of the devices in the circuit shown in FIG. 2.

Step 2: the input in Driving Signal Ste is a high level, the input in First Clock Signal Cke1 is a low level, and the input in Second Clock Signal Cke2 is a high level; as shown in FIG. 4, Second Transmission Control Transistor M17 and Third Transmission Control Transistor M3 turn on under the action of the low level in First Clock Signal Cke1; Second Capacitor C5 is charged so that First Reference Node NET4 is High Level Voltage VDD; Third Transmission Control Transistor M3 provides Low Level Voltage VEE to Fourth Reference Node NET6; Sixth Transmission Control Transistor M14 and Ninth Transmission Control Transistor M11 turn on; Voltage Stabilizer M10 turns on under the control of Low Level VEE; in the meantime, First Driving Transistor M13 and Second Driving Transistor M16 turn off; Output End E1 is Low Level Voltage VEE.

Figure 5:
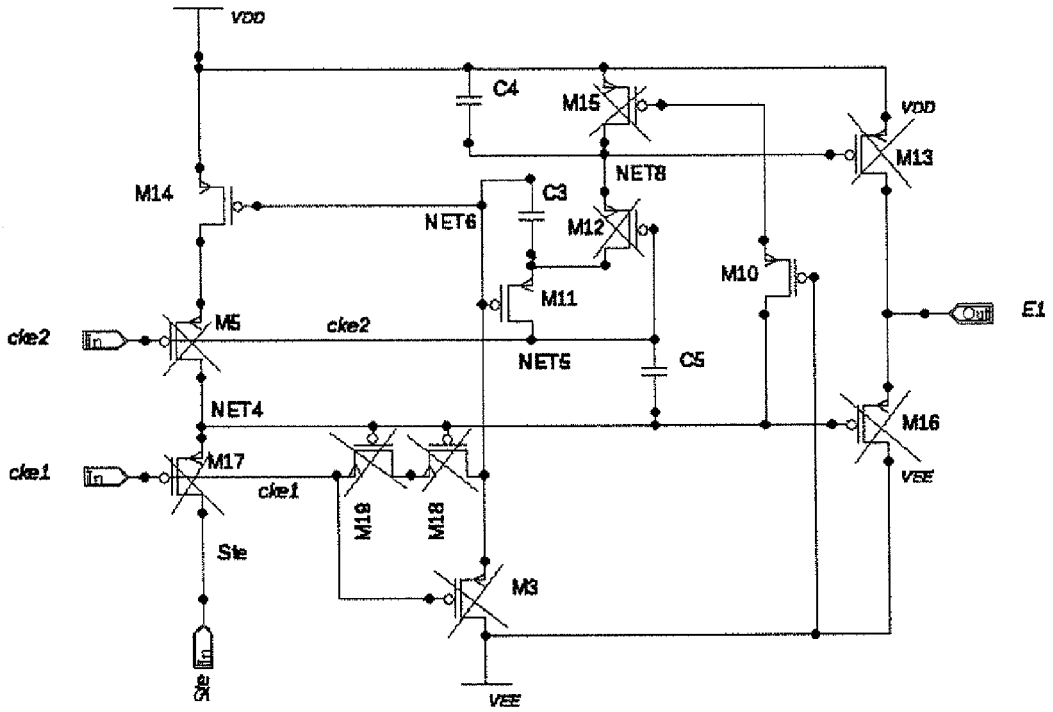
FIG. 5 is a schematic of Step 3 in accordance with the on-off states of the devices in the circuit shown in FIG. 2.

Step 3: the input in Driving Signal Ste is a high level, the input in First Clock Signal Cke1 is a high level, and the input in Second Clock Signal Cke2 is a high level; as shown in FIG. 5, Second Transmission Control Transistor M17 and Third Transmission Control Transistor M3 turn off under the action of the high level in First Clock Signal Cke1; Voltage Stabilizer M10 are still on; the control ends of Ninth Transmission Control Transistor M11 and Sixth Transmission Control Transistor M14 are still maintained as Low Level VEE under the action of Third Capacitor C3; Ninth Transmission Control Transistor M11 and Sixth Transmission Control Transistor M14 turn on; Second Capacitor C5 keeps First Reference Node NET4 at High Level Voltage VDD; First Driving Transistor M13 and Second Driving Transistor M16 turn off; Output End E1 is Low Level Voltage VEE.

Figure 6:
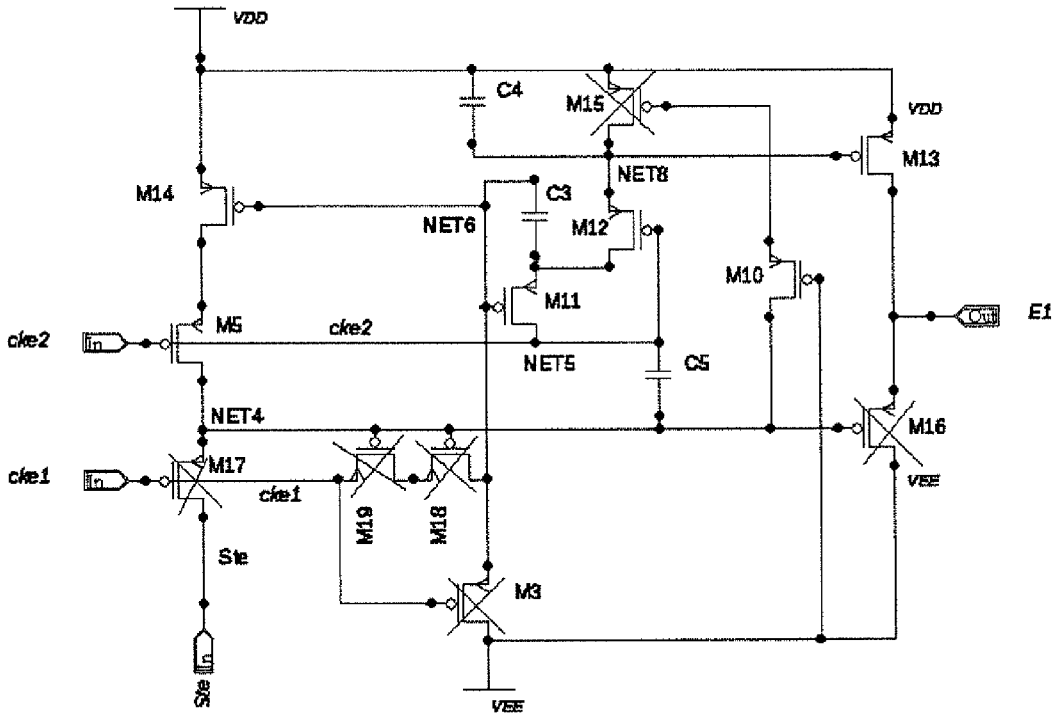
FIG. 6 is a schematic of Step 4 in accordance with the on-off states of the devices in the circuit shown in FIG. 2.

Step 4: the input in Driving Signal Ste is a high level, the input in First Clock Signal Cke1 is a low level, and the input in Second Clock Signal Cke2 is a low level; as shown in FIG. 6, Voltage Stabilizer M10, Ninth Transmission Control Transistor M11 and Sixth Transmission Control Transistor M14 are on, Seventh Transmission Control Transistor M5, Tenth Transmission Control Transistor M12 and First Driving Transistor M13 turn on; Output End E1 is charged to High Level Voltage VDD; Second Driving Transistor M16 turns off; the control end of First Driving Transistor M13, i.e., Third Reference Node NET8 is Low Level VEE; First Driving Transistor M13 turns on; Output End E1 is charged to High Level Voltage VDD.

Figure 7:
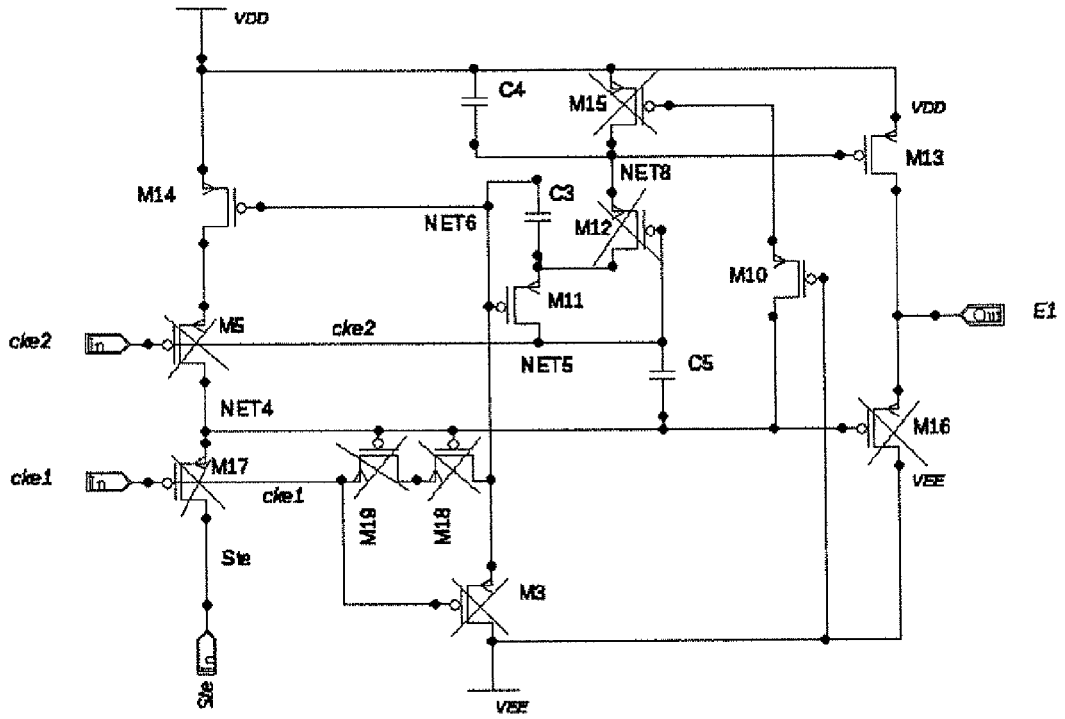
FIG. 7 is a schematic of Step 5 in accordance with the on-off states of the devices in the circuit shown in FIG. 2.

Step 5: the input in Driving Signal Ste is a high level, the input in First Clock Signal Cke1 is a high level, and the input in Second Clock Signal Cke2 is a high level; as shown in FIG. 7, Seventh Transmission Control Transistor M5 and Tenth Transmission Control Transistor M12 turn off under the action of Second Clock Signal Cke2; Voltage Stabilizer M10 is still on under the control of Low Level Voltage VEE; the control ends of Ninth Transmission Control Transistor M11 and Sixth Transmission Control Transistor M14 are still on under the action of the voltage of Third Capacitor C3; the control end of First Driving Transistor M13 is still on under the voltage of First Capacitor C4; Output End E1 is charged to High Level Voltage VDD.

Figure 8:
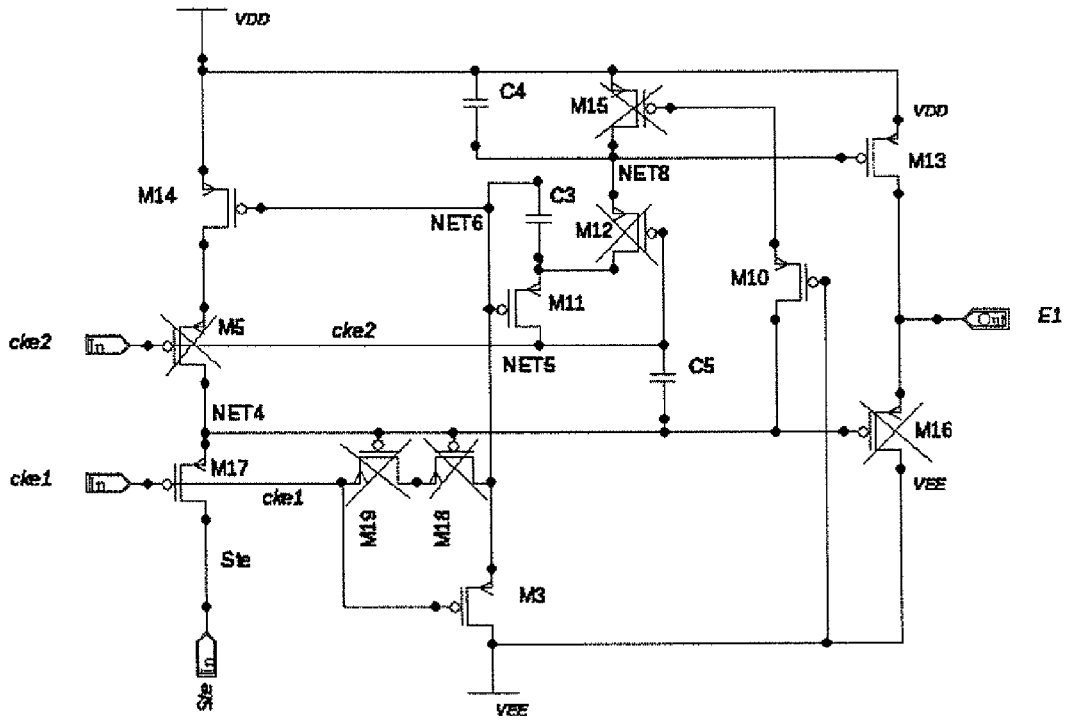
FIG. 8 is a schematic of Step 6 in accordance with the on-off states of the devices in the circuit shown in FIG. 2.

Step 6: the input in Driving Signal Ste is a high level, the input in First Clock Signal Cke1 is a low level, and the input in Second Clock Signal Cke2 is a high level; as shown in FIG. 8, Second Transmission Control Transistor M17 and Third Transmission Control Transistor M3 turn on under the action of the low level in First Clock Signal Cke1; Voltage Stabilizer M10 is still on under the control of Low Level Voltage VEE; the control ends of Ninth Transmission Control Transistor M11 and Sixth Transmission Control Transistor M14 are still on under the action of voltage of Third Capacitor C3; the control end of First Driving Transistor M13 is still on under the action of the voltage of First Capacitor C4; Output End E1 is charged to High Level Voltage VDD.

Figure 9:
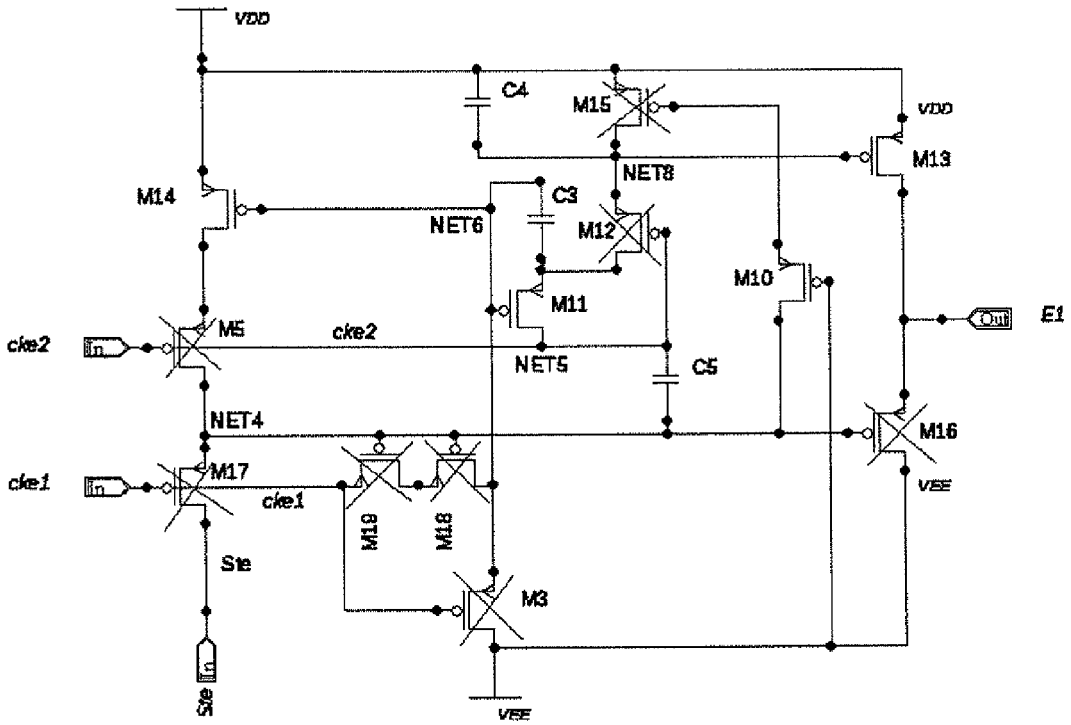
FIG. 9 is a schematic of Step 7 in accordance with the on-off states of the devices in the circuit shown in FIG. 2.

Step 7: the input in Driving Signal Ste is changed from a high level to a low level, the input in First Clock Signal Cke1 is a high level, and the input in Second Clock Signal Cke2 is a high level; as shown in FIG. 9, Second Transmission Control Transistor M17 and Third Transmission Control Transistor M3 turn off under the action of Low Level VEE in First Clock Signal Cke1; the control ends of Ninth Transmission Control Transistor M11 and Sixth Transmission Control Transistor M14 are still on under the action of the voltage of Third Capacitor C3; the control end of First Driving Transistor M13 is still on under the action of the voltage of First Capacitor C4; Output End E1 is charged to High Level Voltage VDD.

Figure 10:
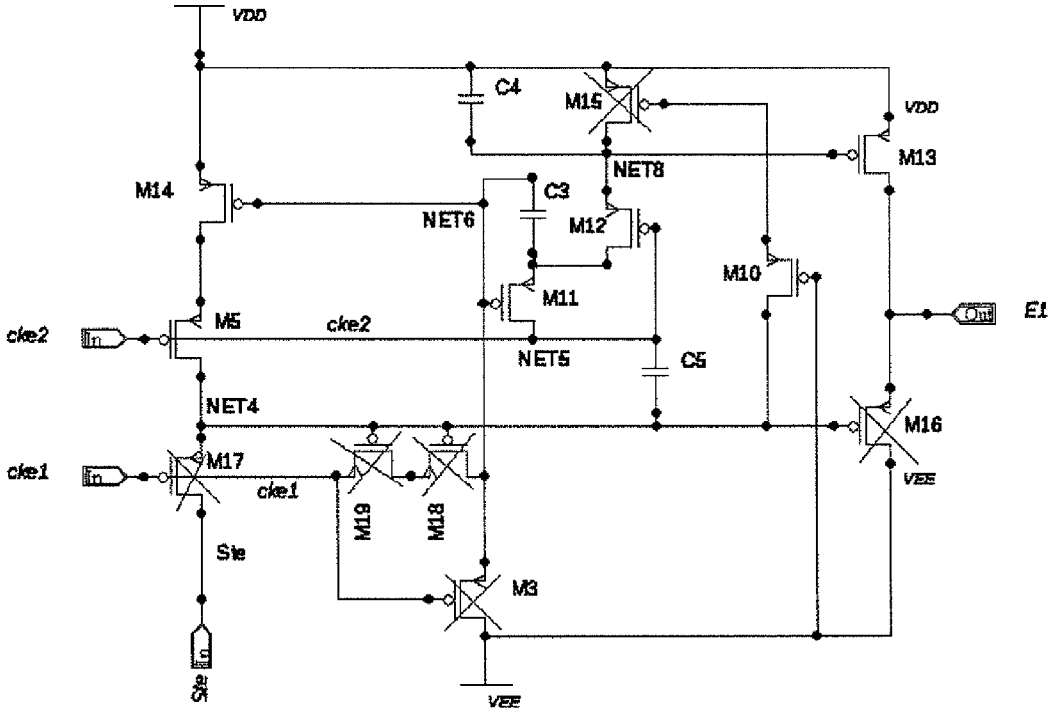
FIG. 10 is a schematic of Step 8 in accordance with the on-off states of the devices in the circuit shown in FIG. 2.

Step 8: the input in Driving Signal Ste is a low level, the input in First Clock Signal Cke1 is a high level, and the input in Second Clock Signal Cke2 is a low level; as shown in FIG. 10, Seventh Transmission Control Transistor M5 and Tenth Transmission Control Transistor M12 turn on under the action of Second Clock Signal Cke2; Voltage Stabilizer M10 is still on under the control of Low Level Voltage VEE; the control ends of Ninth Transmission Control Transistor M11 and Sixth Transmission Control Transistor M14 are still on under the action of the voltage of Third Capacitor C3; the control end of First Driving Transistor M13 is still on under the action of the voltage of First Capacitor C4; Output End E1 is charged to High Level Voltage VDD.

Figure 11:
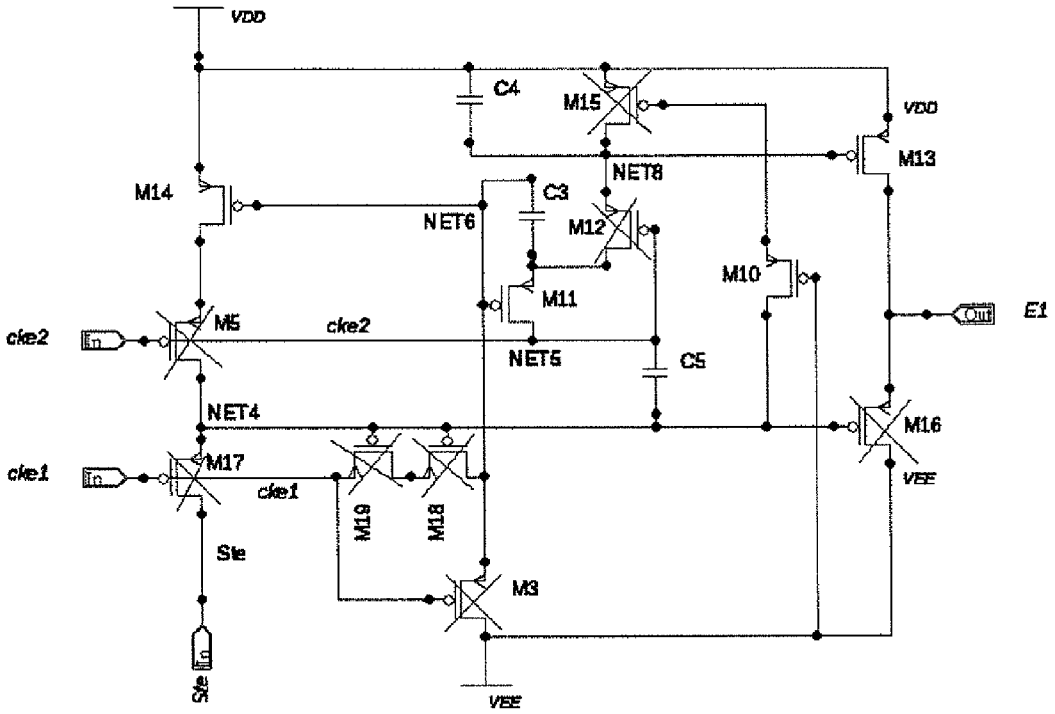
FIG. 11 is a schematic of Step 9 in accordance with the on-off states of the devices in the circuit shown in FIG. 2.

Step 9: the input in Driving Signal Ste is a low level, the input in First Clock Signal Cke1 is a high level, and the input in Second Clock Signal Cke2 is a high level; as shown in FIG. 11, Seventh Transmission Control Transistor M5 and Tenth Transmission Control Transistor M12 turn off under the action of Second Clock Signal Cke2; Voltage Stabilizer M10 is still on under the control of Low Level Voltage VEE; the control ends of Ninth Transmission Control Transistor M11 and Sixth Transmission Control Transistor M14 are still on under the action of the voltage of Third Capacitor C3; the control end of First Driving Transistor M13 is still on under the action of the voltage of First Capacitor C4; Output End E1 is charged to High Level Voltage VDD.

Figure 12:
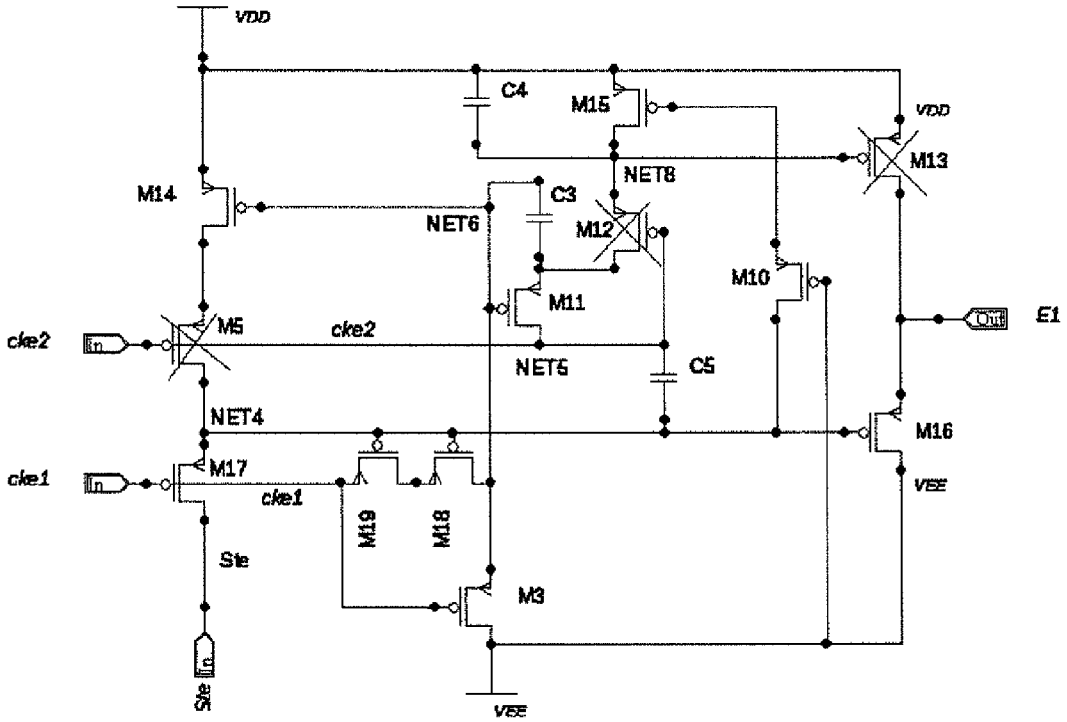
FIG. 12 is a schematic of Step 10 in accordance with the on-off states of the devices in the circuit shown in FIG. 2.

Step 10: the input in Driving Signal Ste is a low level, the input in First Clock Signal Cke1 is a low level, and the input in Second Clock Signal Cke2 is a high level; as shown in FIG. 12, Voltage Stabilizer M10 is still on under the control of Low Level Voltage VEE, Second Transmission Control Transistor M17 and Third Transmission Control Transistor M3 turn on under the action of First Clock Signal Cke1; Third Transmission Control Transistor M3 provides Low Level VEE to the control ends of Sixth Transmission Control Transistor M14 and Ninth Transmission Control Transistor M11; Sixth Transmission Control Transistor M14 and Ninth Transmission Control Transistor M11 turn on; First Reference Node NET4 is Low Level Voltage VEE; First Transmission Control Transistor M15, Fourth Transmission Control Transistor M18 and Fifth Transmission Transistor M19 turn on; Second Driving Transistor M16 turns on; First Driving Transistor M13 turns off; Output End E1 is charged to a voltage a little higher than Low Level Voltage VEE.

Figure 13:
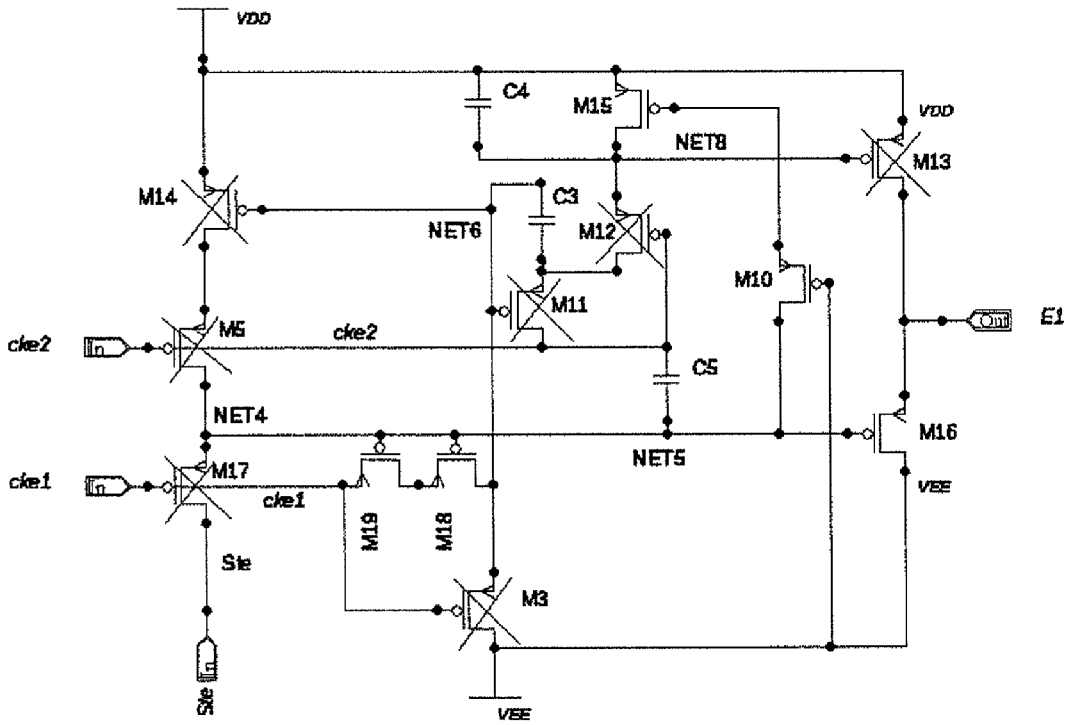
FIG. 13 is a schematic of Step 11 in accordance with the on-off states of the devices in the circuit shown in FIG. 2.

Step 11: the input in Driving Signal Ste is a low level, the input in First Clock Signal Cke1 is a high level, and the input in Second Clock Signal Cke2 is a high level; as shown in FIG. 13, Voltage Stabilizer M10 is still on under the control of Low Level Voltage VEE; Second Transmission Control Transistor M17, Third Transmission Control Transistor M3, Ninth Transmission Control Transistor M11 and Sixth Transmission Control Transistor M14 are off; First Reference Node NET4 is Low Level Voltage VEE; First Transmission Control Transistor M15, Fourth Transmission Control Transistor M18, Fifth Transmission Control Transistor M19 and Second Driving Transistor M16 are still on; Output End E1 is charged to a voltage a little higher than Low Level Voltage VEE.

Figure 14:
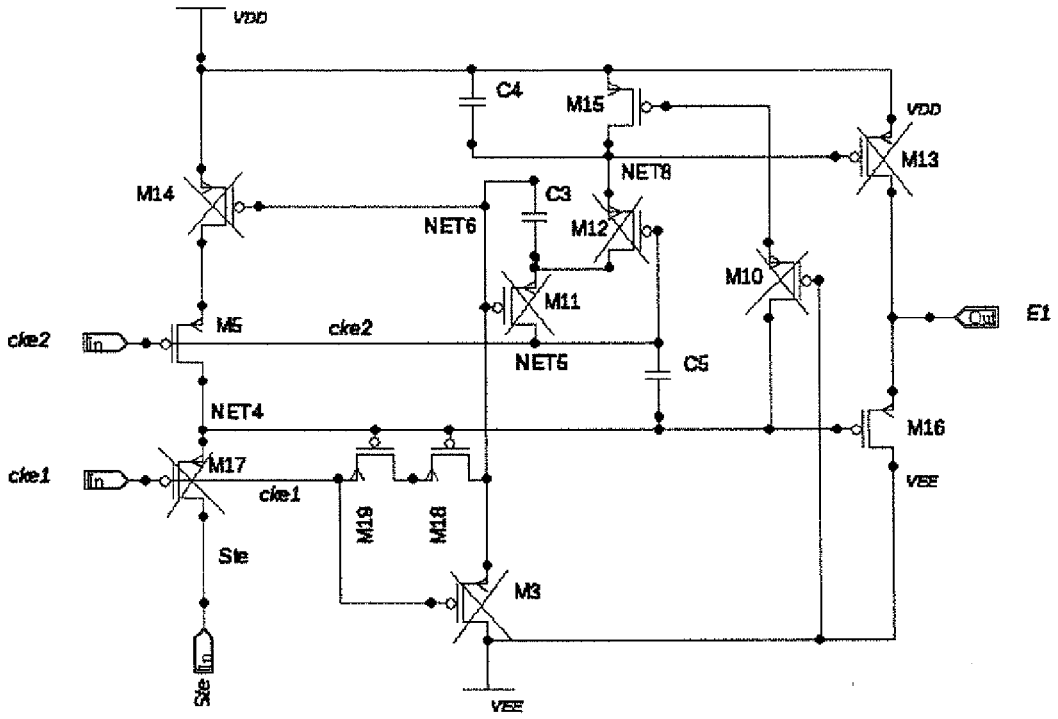
FIG. 14 is a schematic of Step 12 in accordance with the on-off states of the devices in the circuit shown in FIG. 2.

Step 12: the input in Driving Signal Ste is a low level, the input in First Clock Signal Cke1 is a high level, and the input in Second Clock Signal Cke2 is a low level; as shown in FIG. 14, the voltage on First Reference Node NET4 is lower than Low Level Voltage VEE; First Transmission Control Transistor M15, Fourth Transmission Control Transistor M18 and Fifth Transmission Control Transistor M19 are still on; Voltage Stabilizer M10 turns off; Seventh Transmission Control Transistor M5 turns on; Second Driving Transistor M16 is still on; Output End E1 is charged to Low Level Voltage VEE.

Steps 1 to 12 are performed in cycles. As a voltage stabilizer is added between the control end of First Transmission Control Transistor and the control signal according to an embodiment of the present invention, the voltage fluctuations on the control end of the first transmission control transistor is tiny, which will realize the more stable control for the light-emitting signal circuit.

While the present disclosure has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A light-emitting signal control circuit, comprising:

a first driving transistor, for allowing a first voltage to be output from a first voltage source (VDD) to an output end (E1) when controlled by a first low level drive signal;

a second driving transistor, for allowing a second voltage to be output from a second voltage source (VEE) to the output end (E1) when controlled by a second low level drive signal;

a first transmission control transistor, connected between the first voltage source (VDD) and a control end of the first driving transistor, for generating a high level drive signal under the action of the second low level drive signal to turn off the first driving transistor;

a control signal unit, for generating the first low level drive signal and the second low level drive signal according to a set of control signals which are input into the control signal unit; and a voltage stabilizer, connected between the second low level drive signal and the control end of the first transmission control transistor, for stabilizing the second low level drive signal.

2. The light-emitting signal control circuit, as claimed in claim 1, wherein the voltage stabilizer is a transistor.

3. The light-emitting signal control circuit, as claimed in claim 1, wherein:

the control signal comprises a driving signal (Ste) controllably outputting metabolic level signals to a first reference node, said first reference node is connected to the control end of the second driving transistor.

4. The light-emitting signal control circuit, as claimed in claim 3, wherein:

the first voltage source (VDD) is connected to the first reference node by connecting with a sixth transmission control transistor and a seventh transmission control transistor in series, and the first voltage source (VDD) controllably outputs a high level drive signal to the first reference node.

5. The light-emitting signal control circuit, as claimed in claim 4, further comprising:

a second clock signal, connected to a second reference node, for outputting high level signals or low level signals to the second reference node;

wherein, the second clock signal is connected to the control end of the seventh transmission control transistor.

6. The light-emitting signal control circuit, as claimed in claim 5, wherein:

the second reference node is connected to a third reference node by connecting with a ninth transmission control transistor and a tenth transmission control transistor in series, said third reference node is connected to the control end of the first driving transistor to provide the first low level drive signal and said second reference node is connected to the control end of the tenth transmission control transistor.

7. The light-emitting signal control circuit, as claimed in claim 6, further comprising:

a fourth reference node;

wherein, a third transmission control transistor is connected in series between the fourth reference node and the second voltage source (VEE) to controllably output a third low level drive signal to the fourth reference node.

8. The light-emitting signal control circuit, as claimed in claim 7, wherein:

the control signal comprises a first clock signal connecting to the control end of the third transmission control transistor.

9. The light-emitting signal control circuit, as claimed in claim 8, wherein:

the first clock signal outputs high level signals to the fourth reference node by connecting with a fifth transmission control transistor and a fourth transmission control transistor in series; the control end of the fifth transmission control transistor and the control end of the fourth transmission control transistor are connected to the first reference node.

10. The light-emitting signal control circuit, as claimed in claim 1, further comprising:

a first capacitor, coupled between the first voltage source (VDD) and the control end of the first driving transistor, for maintaining the voltage on the control end of the first driving transistor.

11. The light-emitting signal control circuit, as claimed in claim 5, further comprising:

a second capacitor, connected the first reference node and the second reference node, for maintaining the coupling of voltage or capacitance in a preset time to pull down voltages.

12. The light-emitting signal control circuit, as claimed in claim 7, further comprising:

a third capacitor whose one end is connected to the fourth reference node and another end is connected to the node where the ninth transmission control transistor connects to the tenth transmission control transistor in series.

13. The light-emitting signal control circuit, as claimed in claim 7, wherein the fourth reference node is connected to the control end of the ninth transmission control transistor and to the control end of the sixth transmission control transistor.

14. The light-emitting signal control circuit, as claimed in claim 8, further comprising:

a second transmission control transistor whose control end is connected to the first clock signal and connects the driving signal and the first reference node under the control of the first clock signal.

* * * * *